US005900594A

United States Patent [19]

Monson

[11] Patent Number: 5,900,594

[45] Date of Patent: May 4, 1999

[54] SPEAKER CABINET

[76] Inventor: Eric H. Monson, 2401 E. Humboldt, Apt. C3, Pierre, S. Dak. 57501

[21] Appl. No.: 09/064,666

[22] Filed: Apr. 22, 1998

[51] Int. Cl.[6] ..... A47B 81/06

[52] U.S. Cl. ..... 181/199

[58] Field of Search ..... 181/148, 153, 181/154, 199, 144

[56] References Cited

U.S. PATENT DOCUMENTS

| | | | |
|---|---|---|---|
| 2,359,348 | 10/1944 | Barclay | 181/199 |
| 5,253,933 | 10/1993 | Walker . | |
| 5,284,222 | 2/1994 | Ito . | |
| 5,576,522 | 11/1996 | Taso . | |
| 5,661,271 | 8/1997 | Moser | 181/199 |

*Primary Examiner*—Khanh Dang
*Attorney, Agent, or Firm*—Gene R. Woodle

[57] ABSTRACT

Embodiments of a speaker stand are disclosed which include a unique speaker cabinet. The cabinet is constructed by drawing a freeform enclosed shape on a board and drawing smaller concentric versions of the enclosed shape. The enclosed shapes are cut out of the board at an angle of 45 degrees to form a series of concentric rings. The body of the cabinet is made by attaching the smaller face of the largest of the rings created to the larger face of the next largest of the rings and continuing to attached the rest of the rings in a similar manner. A face plate is provided to which speakers may be attached. The face plate has the same size and shape as the largest of the rings and may be attached to that ring to form an enclosed cabinet. The top end of a stem is attached to the cabinet and the bottom end attached to a base plate.

12 Claims, 4 Drawing Sheets

SPEAKER CABINET

BACKGROUND OF THE INVENTION

Field of the Invention

The present invention relates generally to speaker cabinets and more particularly to a combination speaker cabinet and stand.

Background Information

Speakers for hi-fi and stereo systems are ordinarily placed within some type of cabinet. The use of a cabinet is not only believed to improve the sound quality of the speakers, but also provides a convenient structure for wiring and transporting the speakers. There are a number of additional types of speaker systems including surround sound and wireless speakers.

There are a variety of speaker types including woofers and tweeters which are ordinarily included within a speaker cabinet. Woofers generally have a low frequency response and produce a bass tone. Tweeters generally have a high frequency response and produce a treble tone. When a speaker cabinet is placed upon the floor, the speaker becomes "grounded" to the floor and the quality of both the bass and treble tones are affected by this grounding. Research and experience have shown that most listeners prefer the quality of sound produced by speakers when the speaker is at approximately ear level, and is elevated above the floor. In some cases better sound quality may be achieved when speakers are grounded, but elevated.

To alleviate problems relating to creating a cabinet for speakers and for elevating speakers above the floor, a number of speaker cabinets and speaker stands have been invented. Patents have been issued on a large number of speaker cabinets and they are well known in the prior art. Patents have also been issued for a variety of speaker stands.

Such a speaker cabinet is illustrated by the patent issued to Ito (U.S. Pat. No. 5,284,222; Feb. 8, 1994). This speaker cabinet is essentially a plywood box which has openings at the top and bottom which may be closed with a top and bottom plate. Speakers are placed within the box facing outward and aligned with holes in a wall of the box. The openings have the shape of a horn with a diameter which increases from the inside of the box to the outside of the box.

The patent issued to Walker (U.S. Pat. No. 5,253,933; Oct. 19, 1993) discloses a speaker stand. The stand includes an outer portion and an inner portion. The inner portion includes a top member and a bottom member and two U-shaped connecting members. The connecting members are configured such that the slots of the U may be inserted into each other so that the connecting members form a cross. The crossed connecting members fit into slots on the bottom of the top member and the top of the bottom member so that the inner portion creates a stand. The outer member is essentially a box with an open bottom. The outer member fits over the inner member and rests upon the top surface of the top member. A conventional speaker cabinet then rests upon the top of the outer member.

Another speaker stand is disclosed in the patent issued to Taso (U.S. Pat. No. 5,576,522; Nov. 19, 1996). This invention is a stand for a conventional speaker cabinet. A hole is made in the bottom of the conventional speaker cabinet. A connecting device is inserted into the hole. An upper tube may be affixed to the bottom of the speaker cabinet by means of the connecting device such that the interior of the speaker cabinet is open to the interior of the upper tube. The upper tube is connected to a lower tube with the interior of the upper tube open to the interior of the lower tube. The bottom of the lower tube is affixed to a mounting device on a base. The base supports the entire structure such that the cabinet is supported above the stand upon the two tubes.

Although the above described inventions address problems relating to creation of a speaker cabinet and creation of a speaker stand, none of them solve both sets of problems by creating a combination speaker cabinet and speaker stand. Ito does not include a stand and both Walker and Taso are made to be used with conventional speaker cabinets.

The instant invention is a speaker stand which is unique, original, and fills the need for a new and improved speaker cabinet as well as a speaker stand for elevating the cabinet above the floors. In addition, the speaker stand of the instant invention provides an attractive and functional design for a speaker cabinet which is unknown in the prior art.

The ideal speaker stand provides both a speaker cabinet and a stand for elevating the cabinet above the floor. The ideal speaker stand should also provide a method for wiring the speakers which is secure, which is convenient, and which hides the wires to provide an attractive appearance. The ideal speaker stand should also provide a speaker cabinet which is unique and attractive as well as functional. The ideal speaker stand should also be constructed in a manner which uses the least amount of material. The entire speaker stand including both the stand and the cabinet should also be unique and attractive as well as functional. The ideal speaker stand should also be simple to use, lightweight, durable, compact, and inexpensive.

SUMMARY OF THE INVENTION

The speaker stand of the instant invention performs the functions of a conventional speaker cabinet, and is also a speaker stand to elevate the cabinet above the floor. The design of the speaker stand of the instant invention is not only functional, but also includes a unique and attractive design.

The instant invention includes a cabinet, a stem, and a base. The cabinet consists of an open, hollow case and a face plate which fits over the open end of the case to form an enclosed cabinet. The case is made by drawing an enclosed, freeform shape on a piece of wood and drawing concentric versions of the shape with each of the concentric versions being smaller than the original shape and the distances between complimentary points on the concentric shapes being equal. With the piece of wood being horizontal, the concentric shapes are cut away from each other with a saw blade and with the saw blade being at an angle of approximately 45 degrees from the horizontal. A series of concentric, freeform, rings are created by this process with the outer edge of the largest ring being larger than the outer edge of the next largest ring and the inner edge of the largest ring being smaller than the outer edge of the next largest ring. The rings may then be glued together with the smaller face of the largest ring being glued to the larger face of the next largest ring and continuing until all of the rings have been glued together. The inside of the smallest ring is not open and forms an end plate. The larger surface of the end plate is glued to the smaller surface of the smallest ring.

In the preferred embodiment of the speaker stand, the saw cut is made at 45 degrees, but a number of other angles such as 22.5 degrees could be used. In the preferred embodiment, the cuts are described as being made with a saw; but they could be made using other cutting means including a router or laser.

The face plate has the same size and shape as the larger surface on the largest ring. There are a plurality of holes in the face plate. A plurality of conventional speakers may be affixed to the inside face of the face plate with the openings of the speakers aligned with the holes in the face plate. The face plate is attached to the open end of the case with the speakers inside the case.

A portion of the face plate and case are cut away such that a small portion of the interior of the case is exposed. The top of the stem is affixed to the cutaway portion. The stem is hollow and the top of the interior of the stem is in communication with the interior of the case through the cut away portion of the face plate and the case. The bottom of the stem is affixed to the base. The base rests upon the floor and the speaker cabinet is supported above the floor by the stem. Speaker wires run from the speakers and through the stem.

One of the unique features of the instant speaker stand is the attractive and functional design of the speaker cabinet.

One of the major objects of the present invention is to provide a speaker stand which provides both a speaker cabinet and a stand for elevating the cabinet above the floor.

Another objective of the present invention is to provide a speaker stand which provides a method for wiring the speakers which is secure, which is convenient, and which hides the wires to provide an attractive appearance.

Another objective of the present invention is to provide a speaker stand which includes a speaker cabinet which is unique and attractive as well as functional.

Another objective of the present invention is to construct a speaker stand in a manner which uses the least possible amount of material.

Another objective of the present invention is to provide an entire speaker stand including both the stand and the cabinet which is unique and attractive as well as functional.

Another objective of the present invention is to provide a speaker stand which is simple to use, lightweight, durable, compact, and inexpensive.

These and other features of the invention will become apparent when taken in consideration with the following detailed description and the drawings.

DESCRIPTION OF A PREFERRED EMBODIMENT

Figure 1:
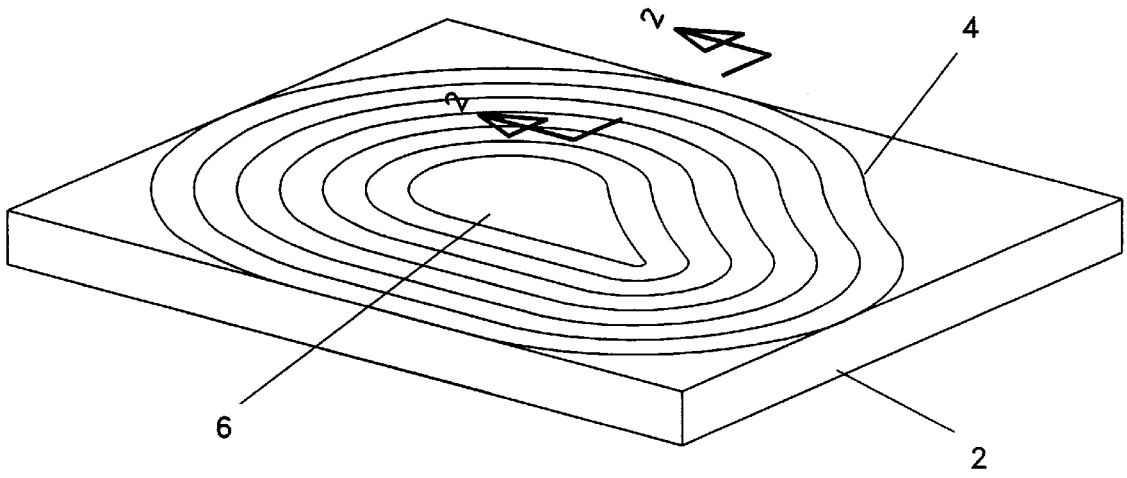
FIG. 1 is a perspective view of a board used to create a preferred form of the speaker cabinet of a the speaker stand of the present invention.

Referring to the drawings, FIGS. 1 through 8, there is shown a preferred form of the speaker stand embodying the present invention.

Referring to FIG. 1, a board for creation of the speaker cabinet portion of the present invention is shown. A board 2 having the approximate size as the largest dimension of the speaker cabinet desired is selected. A freeform shape 4 having the size and shape of the desired speaker cabinet is drawn upon the board 2. A series of concentric, smaller copies of the freeform shape 4 are drawn upon said board 2 inside said freeform shape 4. The number of concentric copies is equal to the desired depth of the speaker cabinet divided by the thickness of said board 2. The distance between all the concentric copies is the same at all complementary points and is approximately the same as the thickness of said board 2. The smallest of the concentric copies describes an end plate 6. Said freeform shape 4 may be nearly any enclosed shape as long as it is possible to create the necessary concentric copies and the shape of the end plate 6.

Figure 2:
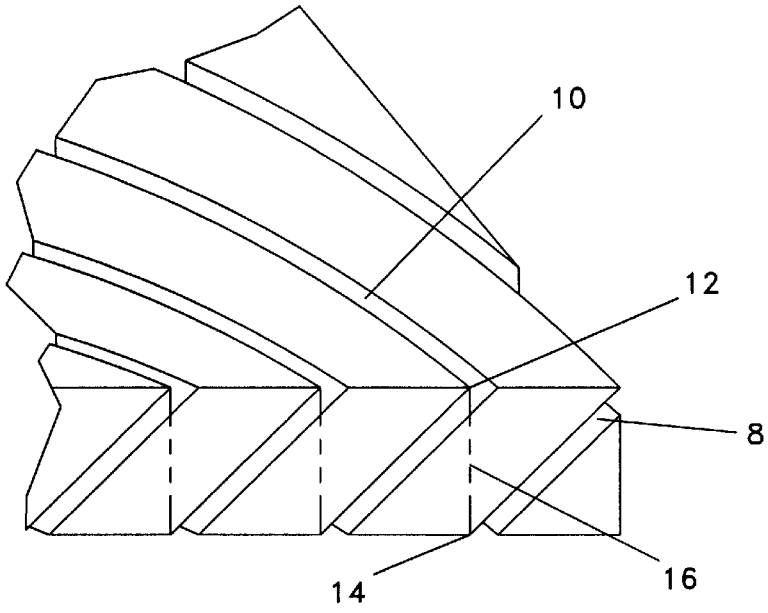
FIG. 2 is a sectional view of the board shown in FIG. 1 taken along line 2—2 of FIG. 1.

Referring now to FIG. 2, a sectional view of said board 2 taken along line 2—2 of FIG. 1 is shown which indicates the method of sawing said board 2. A first saw line 8 is shown. Said board 2 is sawed along saw line 8 such that said saw line 8 is at approximately forty-five degrees to the top plane of said board 2 and the inside face of said saw line 8 follows said freeform shape 4. After said saw line 8 has been cut around the entire perimeter of said freeform shape 4; a second saw line 10 is cut at the same angle as said saw line 8 around the entire perimeter of the first of the concentric copies of said freeform shape 4. The inside, top of the second saw line 10 when cut as indicated by top point 12, is made such that the top point 12 is vertical from the inside, bottom of said first line 8 as it is cut and is shown by a bottom point 14. The phantom line 16 indicates the vertical relationship between said first saw line 8 and said second saw line 10. Each of the rest of the concentric copies of said freeform shape 4 are then cut out in the same manner as described above. Each of the cuts following the cut made at said saw line 8 results in the creation of a ring having the same shape as said freeform shape 4. The innermost of the saw cuts also creates said end plate 6. Although the distance between the concentric copies is described as being approximately the same as the thickness of said board 2 and the angle of the saw cuts is described at being approximately forty-five degrees; this distance and this angle may be varied as long as the vertical relationship indicated by phantom line 16 is maintained.

Figure 3:
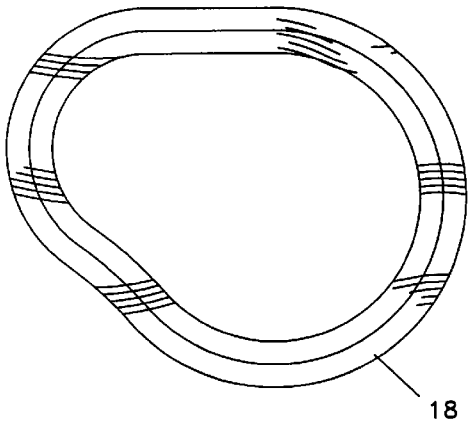
FIG. 3 is a top view of a ring created by cutting the board shown in FIG. 1 on as shown in FIG. 2.

Referring now to FIG. 3, a top view of the largest ring 18, created by the process described above, is shown. The other rings created have the identical shape as the largest ring 18, but are smaller.

Figure 4:
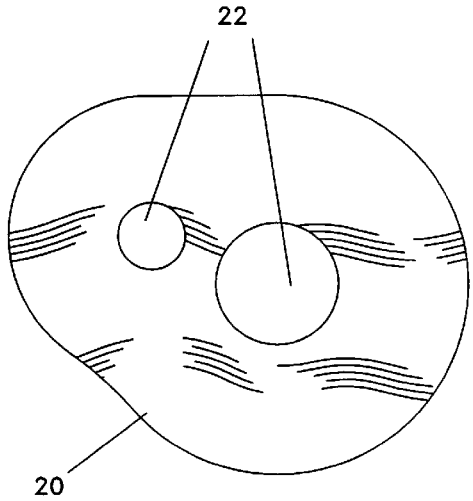
FIG. 4 is a top view of the face plate used to create the speaker cabinet of the instant invention.

Referring now to FIG. 4, the top plate 20 of the speaker cabinet of the speaker stand of the present invention is shown. The top plate 20 is the same shape as said largest ring 18 and is the same size as the outer edge of said largest ring 18. A plurality of holes 22 equal in number to the number of speakers which will be mounted in the speaker cabinet are cut through said top plate 20. The holes 22 are slightly smaller than the largest dimension of the relevant speakers.

Figure 5:
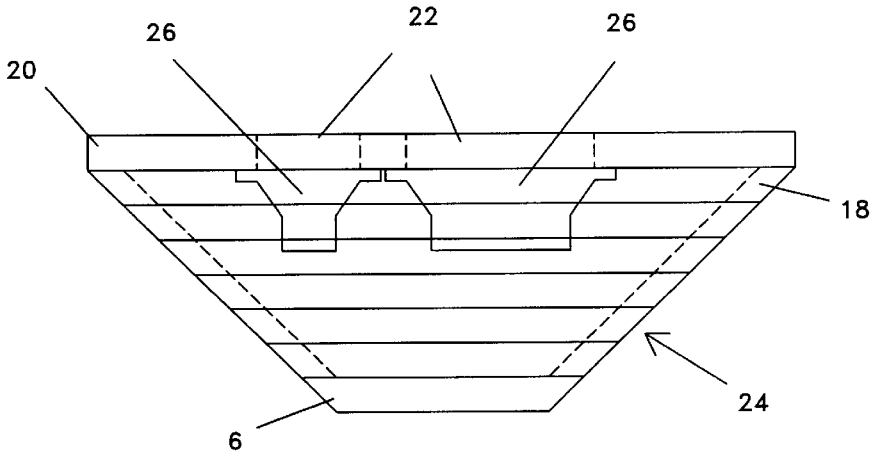
FIG. 5 is a side view of a preferred form of the speaker cabinet of the present invention.

Referring now to FIG. 5, a side view of the speaker cabinet 24 of the instant invention is shown. The desired speakers 26 are mounted to said face plate 20 such that the openings of said speakers 26 are aligned with said holes 22.

The speaker cabinet is created by gluing the second largest ring to said largest ring 18 with the larger face of the next largest ring affixed to the smaller face of said largest ring 18. The rest of the rings are glued together in a similar fashion with said end plate 6 being glued to the smallest of the rings. The largest face of said largest ring 18 is aligned with the face of said face plate 20 to which said speakers 26 are mounted. Attachment of speaker wires may be facilitated not gluing said largest ring 18 to said face plate 20 until after the steps described below are completed.

Figure 6:
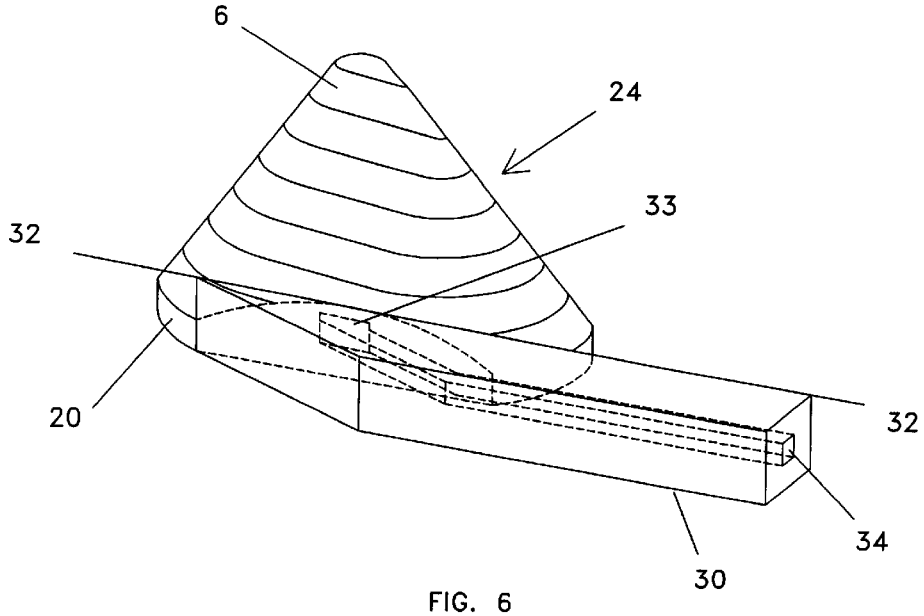
FIG. 6 is a perspective view of the speaker cabinet of the present invention and the stem of the present invention.

Referring now to FIG. 6, a perspective view of said speaker cabinet 24 and a stem 30 is shown. A section of said speaker cabinet 24 is cut away along line 32—32 and perpendicular to said face plate 20. The cut away section is of sufficient depth that an opening 33 is created into the interior of said speaker cabinet 24. The opening 33 is just large enough to allow speaker wires to be conveniently threaded through said opening 33. The necessary speaker wires are connected to said speakers 26 and threaded through said opening 33. Said face plate 20 is then glued to said largest ring 18. Said face plate 20 may be affixed to said largest ring 18 by means of screws or other means which allow said face plate 20 to be removed if necessary. The stem 30 has width and thickness to support the weight or said speaker cabinet 24 and to allow for a hollow core 34 of sufficient size to allow speaker wires to be threaded through the hollow core 34. Said stem 30 has sufficient length to allow said speaker cabinet 24 to be elevated above the floor at the desired height. Said hollow core 34 is created such that the upper end of said hollow core 34 may be aligned with said opening 33 in said speaker cabinet 24. The speaker wires are threaded from said speaker cabinet 24 through said hollow core 34. The upper end of said stem 30 is glued to said speaker cabinet 24 at the surface created when the portion of said speaker cabinet 24 was cut away along line 32—32. Said stem 30 may be affixed to said speaker cabinet 24 with a combination of glue and screws or other fastening means such that said face plate 20 may be removed from said speaker cabinet 24.

Figure 7:
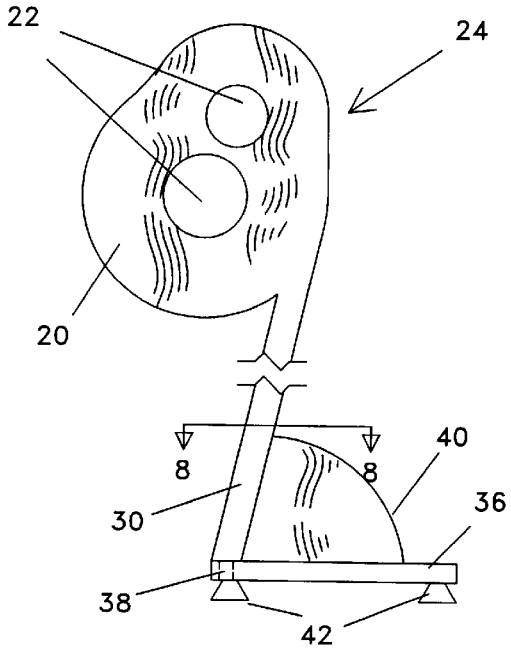
FIG. 7 is a front view of a preferred form of the speaker stand of the present invention.

Referring now to FIG. 7, a front view of the speaker stand of the present invention is shown. A base plate 36 is provided. There is a plate hole 38 in the base plate 36 in the middle of one end of said base plate 36. The speaker wires are threaded through the plate hole 38 and the bottom of said stem 30 is affixed to the top of said plate 36 over said plate hole 38. The angle of the portion of said speaker cabinet 24 cut away and the angle of the bottom of said stem 30 are constructed such that the center of said face plate 20 is approximated above the center of said base plate 36. A gusset 40 is provided and is glued to the edge of said stem 30 and the top of said base plate 36 to provide stability to the speaker stand. Four feet 42 are affixed to the bottom corners of said base plate 36.

Figure 8:
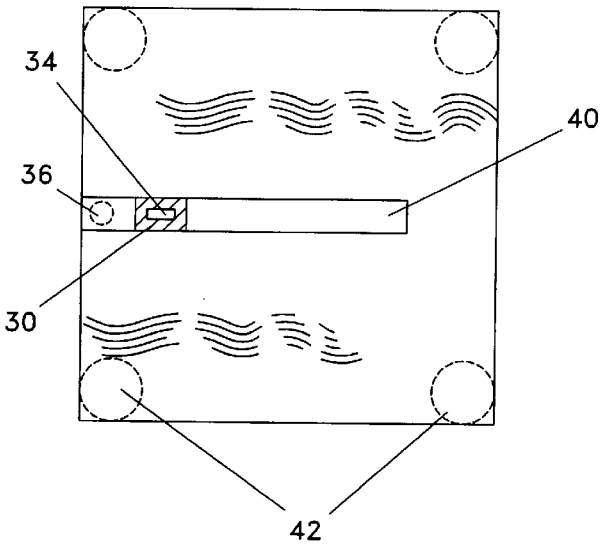
FIG. 8 is a sectional view of a preferred form of the speaker stand of the present invention taken along line 8—8 of FIG. 7.

Referring now to FIG. 8, a sectional view of showing the top of said base plate 36 is shown. This view shows the position of the gusset 40 relative to said base plate 36. This view also shows the position of the four feet 42 in the corners of said base plate 36.

After the speaker stand of the present invention has been constructed, the speaker wires may be connected in a conventional manner to a hi-fi amplifier or other desired device. Although this embodiment of the speaker stand is shown for placement of two speakers, other numbers of speakers could be used. A single speaker stand is shown, but speaker stands could be used in pairs or other configurations.

In the preferred embodiment of the speaker stand all components are made of solid wood because of the well known sound production qualities of that material, but other materials such as plywood or plastic could be used provided that those materials produced the sound quality desired. The speakers used could be any of a number of conventional speakers. The speaker wire could be any of a number of types of conventional speaker wire. Although the cuts in said board 2 are described above as being sawed, the cuts could be made by other methods including a router or laser. In the preferred embodiment of the instant invention, provision is made for speaker wire by making a cut along line 32—32 to create an opening 33 and by having a hollow core 34 in said stem 30; but these elements would not be necessary if wireless speakers were used. The concentric ring construction of the speaker stand of the instant invention uses less material to create a similar speaker cabinet than is used in conventional methods of speaker cabinet construction.

In the preferred embodiment of the instant invention, the cuts in said board 2 are described as being at approximately 45 degrees; but other angles between 0 degrees and 90 degrees could be used. If the cuts were made at 22.5 degrees, for example, a deeper cabinet would be created.

Figure 9:
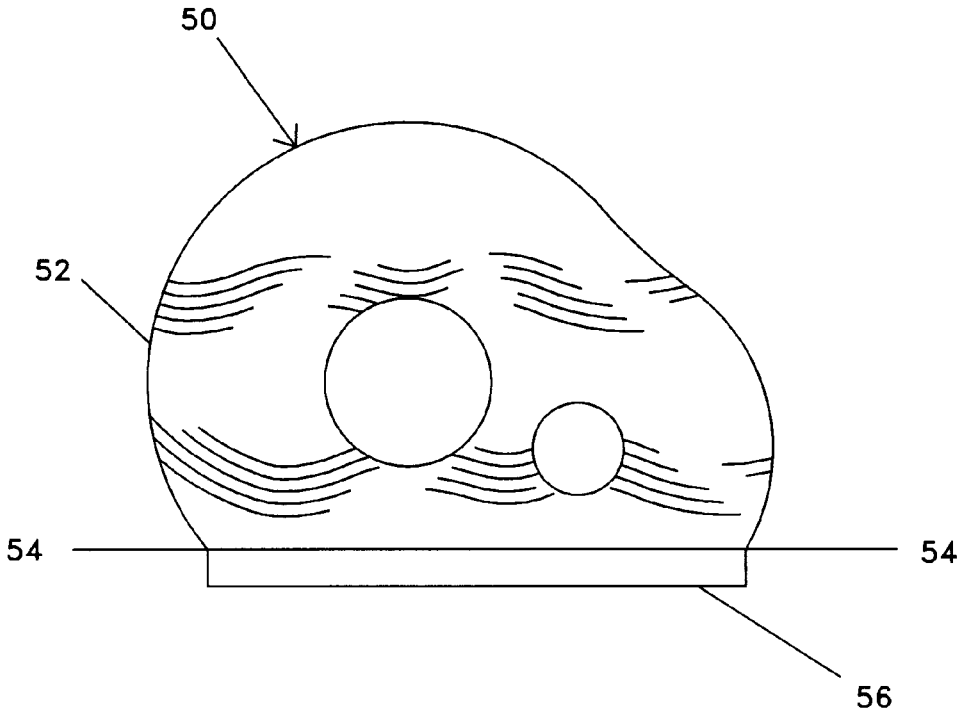
FIG. 9 is a front view of another embodiment of the speaker stand of the present invention.
Figure 10:
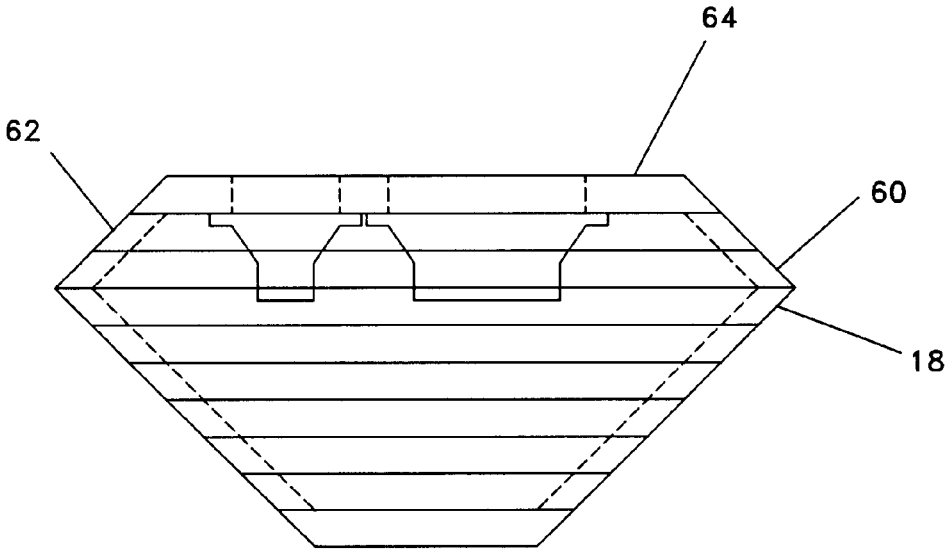
FIG. 10 is a side view of a third embodiment of the speaker stand of the present invention.

Additional embodiments of the speaker stand of the instant invention are shown in FIG. 9 and FIG. 10.

Referring now to FIG. 9, a front view of an embodiment of the speaker stand without said stem 30 and said base plate 36 is shown. The cabinet portion 50 is constructed as described above with a front piece 52. A portion of the cabinet portion 50 is cut away along line 54—54 perpendicular to the front piece 52. A base 56 is attached to said cabinet portion 50. In this embodiment, the speaker stand could be used, for example, as a bookshelf speaker cabinet.

Referring now to FIG. 10, a side view of a third embodiment of the speaker stand of the instant invention is shown. The entire speaker stand is constructed as previously described with the exception of the changes described below. Said face plate 20 is not used in this embodiment. The concentric rings such as said largest ring 18 are the same and a second set of rings are cut as shown by first ring 60 and second ring 62. The larger face of the first ring 60 is attached to the larger face of said largest ring 18; and the larger face of second ring 62 is attached to the smaller face of said first ring 60. An alternate face plate 64 is created in much the same manner as said face plate 20 and is attached to the said second ring 62 to support the speakers. Although two rings, said first ring 60 and said second ring 62, are shown; varying numbers of additional rings could be used.

While preferred embodiments of this invention have been shown and described above, it will be apparent to those skilled in the art that various modifications may be made in these embodiments without departing from the spirit of the present invention. For that reason, the scope of the invention is set forth in the following claims:

I claim:

1. A speaker cabinet comprising:

(1) a hollow body constructed by drawing a freeform, enclosed shape on the top face of a piece of material having a top face, a bottom face, and thickness; drawing a plurality of concentric, smaller versions of the enclosed shape on the top face of the piece of material, cutting rings having said enclosed shape from said piece of material by making cuts along said enclosed shape and the concentric smaller versions of said enclosed shape such that the cuts are at an angle of between 0 degrees and 90 degrees to said top face; attaching the larger face of the second largest of the rings thus created to the smaller face of the largest of the rings thus created and attaching the rest of the rings thus created in a similar manner;

(2) a face plate having a top face, a bottom face, and thickness and having the same shape and size as the larger face of said largest of the rings; the face plate having a plurality of holes perpendicular to the top and bottom faces of said face plate equal to the number of speakers desired to be placed within the speaker cabinet; the speakers being attached to said bottom face of said face plate such that the speakers are aligned with the holes in said face plate; said bottom face of said face plate being attached to the larger face of the largest of said rings;

whereby a speaker cabinet is created consisting of a hollow body having a freeform shape and a plurality of speakers may be attached to a face plate and enclosed within the hollow body by attaching the face plate to the hollow body.

2. The speaker cabinet of claim 1 in which the top end of a stem is attached to the speaker cabinet and the bottom end of the stem is attached to a base such that a speaker stand is created and said speaker cabinet is supported by the stem above the floor upon which the base rests.

3. The speaker cabinet of claim 1 in which an opening is provided in the speaker cabinet through which speaker wires may be passed.

4. The speaker cabinet of claim 2 in which an opening is provided into the speaker cabinet and in which the stem has a hollow core through which speaker wires may be passed.

5. The speaker cabinet of claim 1 in which an additional mirror image copy of said largest ring is constructed and additional mirror image copies of a plurality of the next larger rings are created; the larger face of the additional copy of the largest ring being attached to the larger face of said largest ring; the next larger ring of the additional rings being attached in a similar manner; and said face plate being the same size and shape as the smallest of the additional rings and being attached to said smallest of the additional rings.

6. The speaker cabinet of claim 5 in which the top end of a stem is attached to the speaker cabinet and the bottom end of the stem is attached to a base such that a speaker stand is created and said speaker cabinet is supported by the stem above the floor upon which the base rests.

7. The speaker cabinet of claim 5 in which an opening is provided in the speaker cabinet through which speaker wires may be passed.

8. The speaker cabinet of claim 7 in which an opening is provided into the speaker cabinet and in which the stem has a hollow core through which speaker wires may be passed.

9. The speaker cabinet of claim 1 in which the cuts are at an angle of 45 degrees.

10. The speaker cabinet of claim 9 in which the top end of a stem is attached to the speaker cabinet and the bottom end of the stem is attached to a base such that a speaker stand is created and said speaker cabinet is supported by the stem above the floor upon which the base rests.

11. The speaker cabinet of claim 9 in which an opening is provided in the speaker cabinet through which speaker wires may be passed.

12. The speaker cabinet of claim 10 in which an opening is provided into the speaker cabinet and in which the stem has a hollow core through which speaker wires may be passed.

* * * * *